US005577274A

United States Patent [19]

Plotsky et al.

[11] Patent Number: 5,577,274

[45] Date of Patent: Nov. 26, 1996

[54] WINTERIZING CHECK VALVE SYSTEM

[76] Inventors: David E. Plotsky, 19 A Vasser Pl.; James W. Glander, 103 Croft La., both of Smithtown, N.Y. 11787

[21] Appl. No.: 443,584

[22] Filed: May 17, 1995

[51] Int. Cl.[6] ..... E04H 4/14

[52] U.S. Cl. ..... 4/507; 4/496; 137/539

[58] Field of Search ..... 4/490, 492, 496, 4/506, 507, 508, 509; 137/539, 515.5

[56] References Cited

U.S. PATENT DOCUMENTS

| | | | |
|---|---|---|---|
| 619,705 | 2/1899 | Knupp | 137/539 |
| 1,659,047 | 2/1928 | Quinn | 137/539 |
| 3,530,511 | 9/1970 | Berg et al. | 4/490 |
| 4,154,679 | 5/1979 | Farage | 4/507 |
| 4,346,484 | 8/1982 | Martin | 4/507 |
| 4,368,550 | 1/1983 | Stevens | 4/507 |
| 4,818,389 | 4/1989 | Tobias et al. | 4/507 |

*Primary Examiner*—Henry J. Recla
*Assistant Examiner*—Charles R. Eloshway

[57] ABSTRACT

A winterizing check valve system comprised of a cylindrical check valve having a hollow securement portion and a housing portion. The hollow securement portion is adapted for coupling with an end of a return line for a swimming pool. The housing portion is adapted for securement to the hollow securement portion. The housing portion has a spring therein. The housing portion has a ball coupled therein adjacent to the spring. The housing portion has a plurality of openings therein. The check valve system has an adapter plug having a first end and a second end. The adapter plug has an opening formed therethrough. The first end is adapted to couple with an opposing end of the return line for the swimming pool. The second end is adapted to couple with a compressor.

2 Claims, 4 Drawing Sheets

WINTERIZING CHECK VALVE SYSTEM

BACKGROUND OF THE INVENTION

1. Field of the Invention

The present invention relates to a winterizing check valve system and more particularly pertains to allowing pool owners to purge lines in a swimming pool for winterizing with a winterizing check valve system.

2. Description of the Prior Art

The use of check valves is known in the prior art. More specifically, check valves heretofore devised and utilized for the purpose of preventing back flow of fluids are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,117,863 to McGarrah discloses a backflow valve for use in a post-mix carbonator system for preventing the backflow of carbonated fluid.

U.S. Pat. No. Des. 335,918 to Glansk discloses the ornamental design for a combined check and control valve.

U.S. Pat. No. 5,103,856 to Fleischmann discloses an anti-siphoning valve assembly for preventing the back-flow of water in plumbing systems.

U.S. Pat. No. 4,717,051 to Fleischmann discloses a check valve for water dispenser bottle to prevent or reduce spillage of water while inverting the water bottle that is used in an invertible type water cooler and dispenser.

U.S. Pat. No. 4,633,853 to Prill et al. discloses a hot water tank check valve comprising valve mechanisms employed in the inlet, and outlet to the hot water heater tank to preclude migration of hot water from the tank into the water inlet conduit and the water outlet conduit.

While these devices fulfill their respective, particular objective and requirements, the aforementioned patents do not describe a winterizing check valve system for allowing pool owners to purge lines in a swimming pool for winterizing.

In this respect, the winterizing check valve system according to the present invention substantially departs from the conventional concepts and designs of the prior art, and in doing so provides an apparatus primarily developed for the purpose of allowing pool owners to purge lines in a swimming pool for winterizing.

Therefore, it can be appreciated that there exists a continuing need for new and improved winterizing check valve system which can be used for allowing pool owners to purge lines in a swimming pool for winterizing. In this regard, the present invention substantially fulfills this need.

SUMMARY OF THE INVENTION

In the view of the foregoing disadvantages inherent in the known types of check valves now present in the prior art, the present invention provides an improved winterizing check valve system. As such, the general purpose of the present invention, which will be described subsequently in greater detail, is to provide a new and improved winterizing check valve system and method which has all the advantages of the prior art and none of the disadvantages.

To attain this, the present invention essentially comprises a cylindrical check valve having a hollow securement portion and a housing portion. The hollow securement portion has an open first end with securement means thereon adapted for coupling with an end of a return line for a swimming pool. The hollow securement portion has an externally threaded open second end. The open second end tapers inwardly. The hollow securement portion has a retaining wall inwardly of the externally threaded open second end. The housing portion has an internally threaded open first end, a closed second end, and an intermediate extent therebetween. The internally threaded open first end is adapted for securement to the externally threaded open second end of the hollow securement portion. The housing portion has a spring therein. The spring has a first end and a second end. The first end is secured to the closed second end of the housing portion. The housing portion has a ball coupled therein adjacent to the first end of the spring. The intermediate extent has a plurality of openings therein. A clamp secures the hollow securement portion of the cylindrical check valve to the return line of the swimming pool. The device contains an adapter plug having a first end and a second end. The adapter plug has an opening formed therethrough. The first end is adapted to couple with an opposing end of the return line for the swimming pool. The second end is adapted to couple with a compressor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved winterizing check valve system which has all the advantages of the prior art check valves and none of the disadvantages.

It is another object of the present invention to provide a new and improved winterizing check valve system which may be easily and efficiently manufactured and marketed.

It is a further object of the present invention to provide a new and improved winterizing check valve system which is of durable and reliable construction.

An even further object of the present invention is to provide a new and improved winterizing check valve system which is susceptible of a low cost of manufacture with regard to both materials and labor, and which accordingly is then susceptible of low prices of sale to the consuming public, thereby making such a winterizing check valve system economically available to the buying public.

Still yet another object of the present invention is to provide a new and improved winterizing check valve system which provides in the apparatuses and methods of the prior art some of the advantages thereof, while simultaneously overcoming some of the disadvantages normally associated therewith.

Even still another object of the present invention is to provide a new and improved winterizing check valve system for allowing pool owners to purge lines in a swimming pool for winterizing.

Lastly, it is an object of the present invention to provide a new and improved winterizing check valve system comprised of a cylindrical check valve having a hollow securement portion and a housing portion. The hollow securement portion is adapted for coupling with an end of a return line for a swimming pool. The housing portion is adapted for securement to the hollow securement portion. The housing portion has a spring therein. The housing portion has a ball coupled therein adjacent to the spring. The housing portion has a plurality of openings therein. The check valve system has an adapter plug having a first end and a second end. The adapter plug has an opening formed therethrough. The first end is adapted to couple with an opposing end of the return line for the swimming pool. The second end is adapted to couple with a compressor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
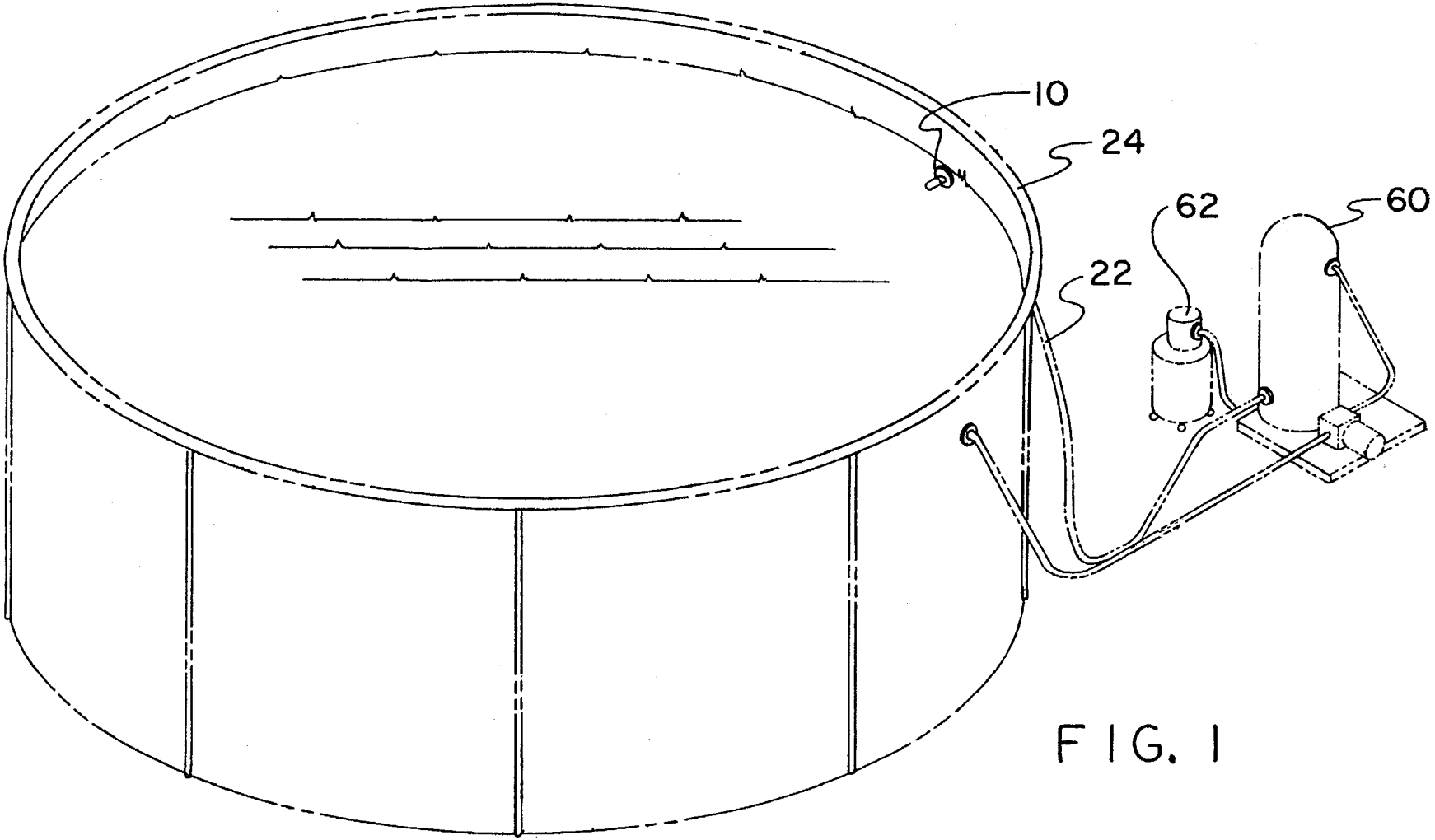
FIG. 1 is a perspective view of the preferred embodiment of the winterizing check valve system constructed in accordance with the principles of the present invention.
Figure 2:
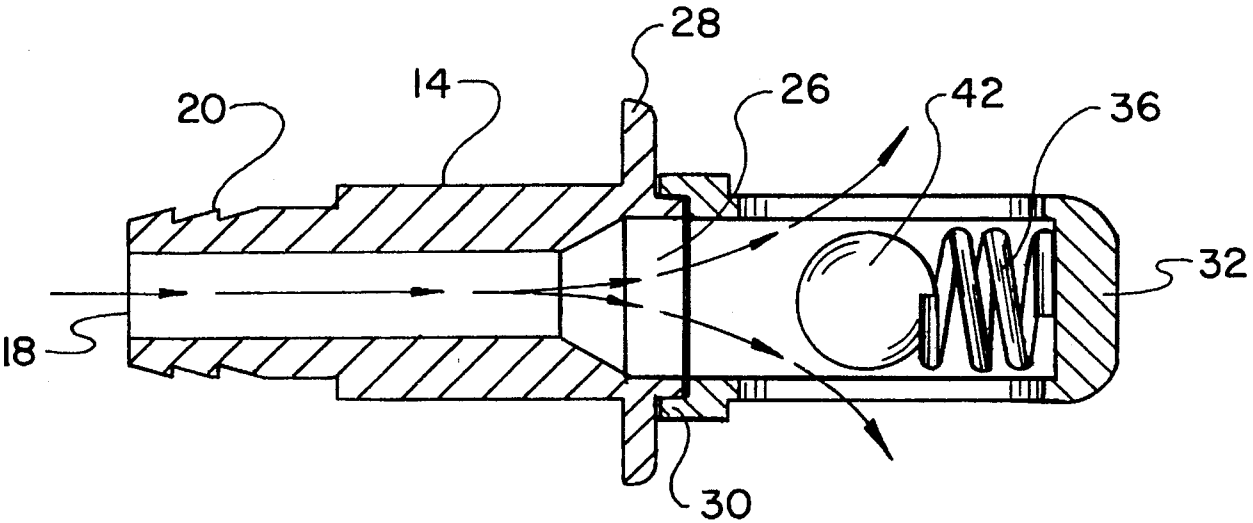
FIG. 2 is a cross-sectional view of the present invention in the purged orientation.
Figure 3:
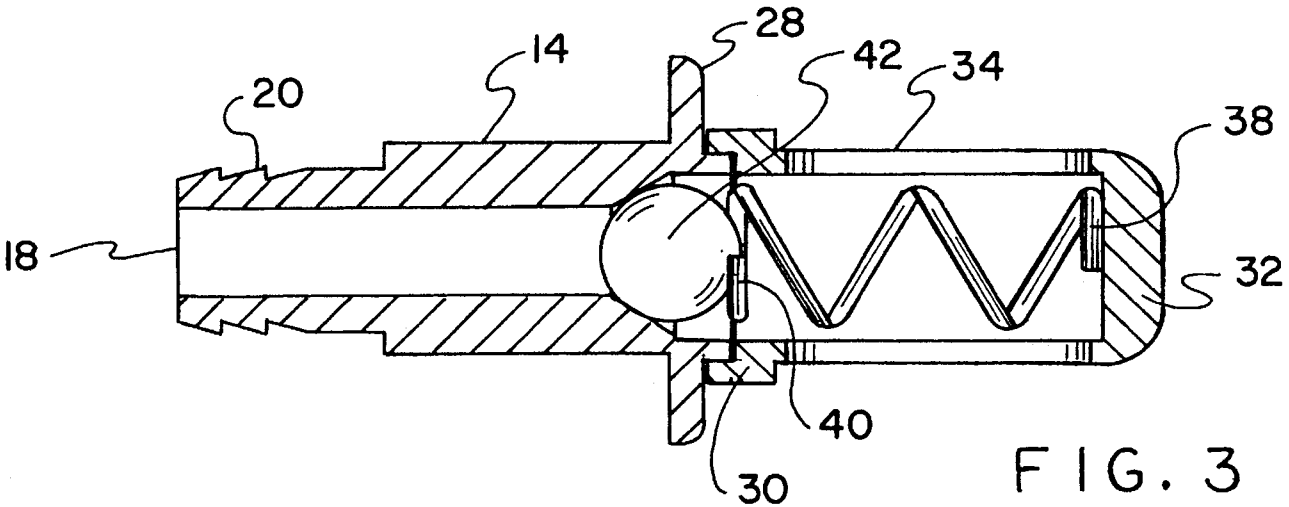
FIG. 3 is a cross-section view of the present invention in the sealed orientation.
Figure 7:
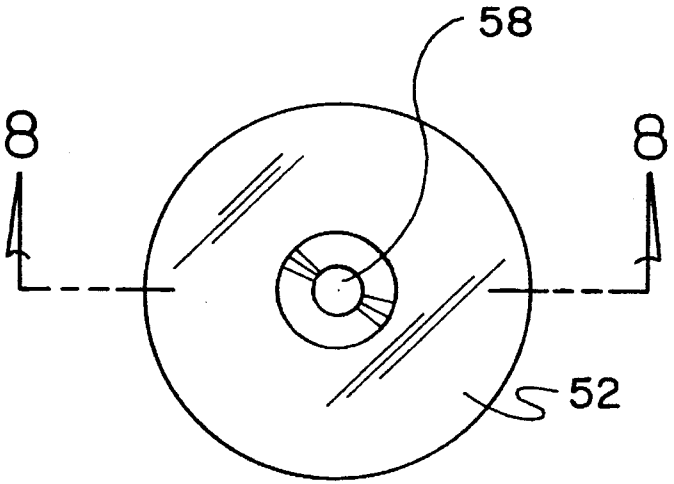
FIG. 7 is a front view of the portable shop-type vacuum cleaner adapter of the present invention.
Figure 8:
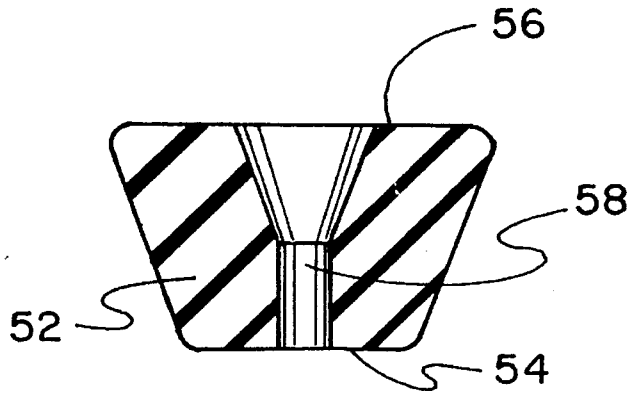
FIG. 8 is a cross-sectional view as taken along line 8—8 of FIG. 7.
Figure 5:
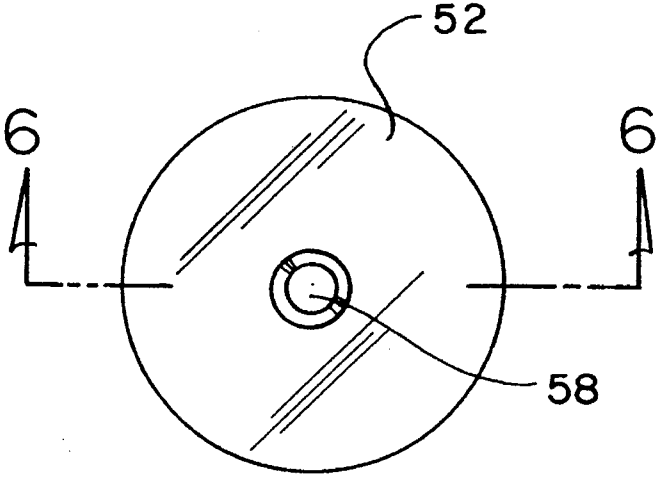
FIG. 5 is a front view of the compressor adapter of the present invention.
Figure 6:
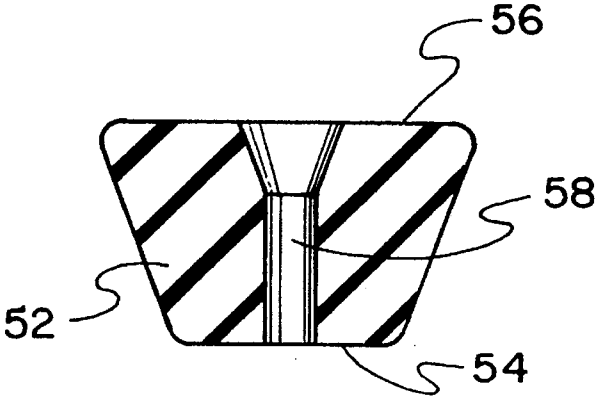
FIG. 6 is a cross-sectional view as taken along line 6—6 of FIG. 5.
Figure 4:
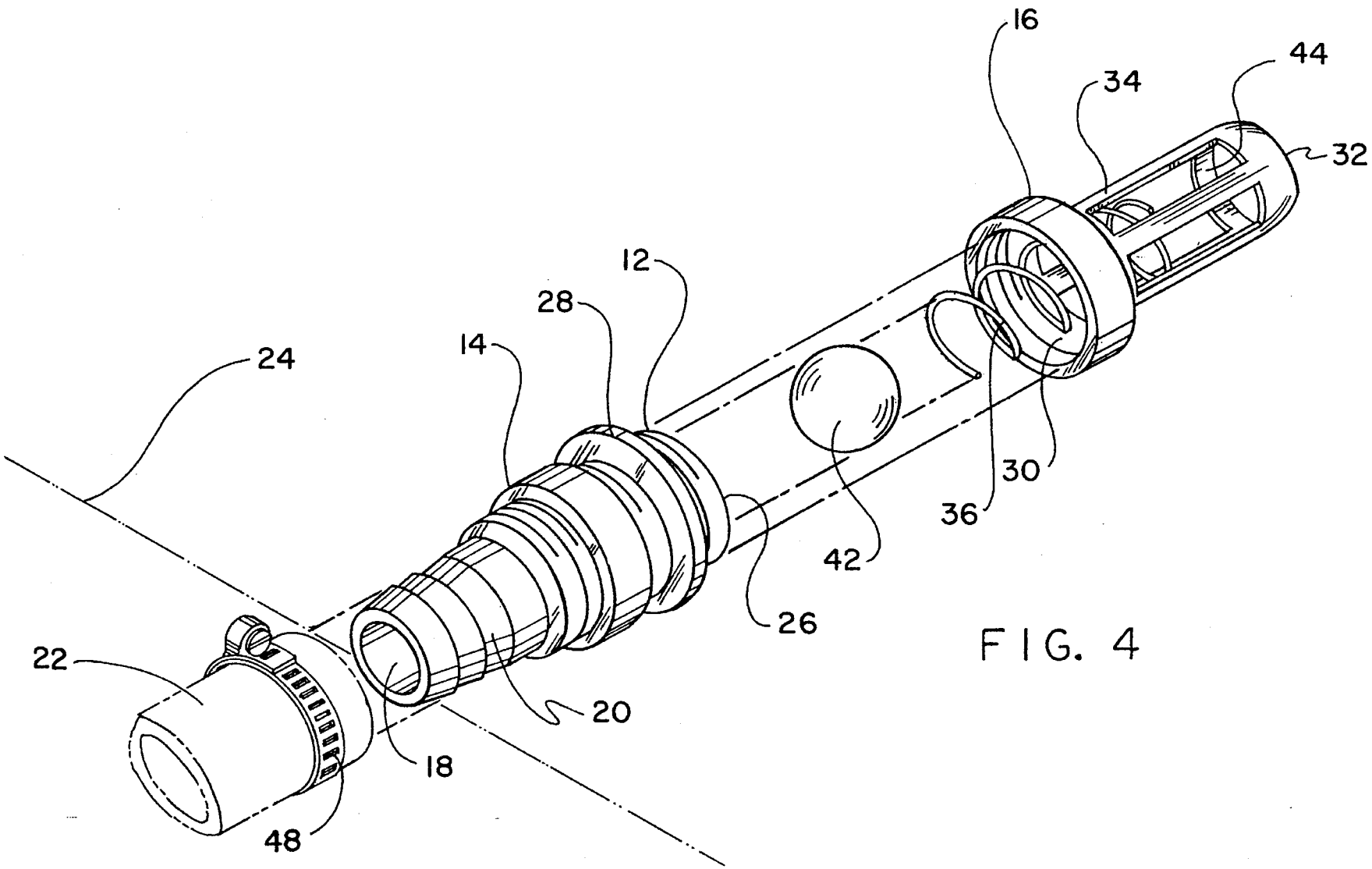
FIG. 4 is an exploded perspective view of the present invention.

With reference now to the drawings, and in particular, to FIG. 1–8 thereof, the preferred embodiment of the new and improved winterizing check valve system embodying the principles and concepts of the present invention and generally designated by the reference number 10 will be described.

Specifically, it will be noted in the various Figures that the device relates to a new and improved winterizing check valve system for allowing pool owners to purge lines in a swimming pool for winterizing. In its broadest context, the device consists of a cylindrical check valve, a clamp, and an adapter plug.

The device 10 contains a cylindrical check valve 12 having a hollow securement portion 14 and a housing portion 16. The hollow securement portion 14 has an open first end 18 with securement means 20 thereon adapted for coupling with an end of a return line 22 for a swimming pool 24. The hollow securement portion 14 has an externally threaded open second end 26. The open second end 26 tapers inwardly. The hollow securement portion 14 has a retaining wall 28 inwardly of the externally threaded open second end 26. The housing portion 16 has an internally threaded open first end 30, a closed second end 32, and an intermediate extent 34 therebetween. The internally threaded open first end 30 is adapted for securement to the externally threaded open second end 26 of the hollow securement portion 14. The housing portion 16 has a spring 36 therein. The spring 36 has a first end 38 and a second end 40. The first end 38 is secured to the closed second end 32 of the housing portion 16. The housing portion 16 has a ball 42 coupled therein adjacent to the first end 38 of the spring 36. The spring 36 biases the ball 42 into the inwardly tapered open second end 26 of the hollow securement portion 14. The intermediate extent 34 has a plurality of openings 44 therein.

A clamp 48 secures the hollow securement portion 14 of the cylindrical check valve 12 to the return line 22 of the swimming pool 24.

The device 10 contains an adapter plug 52 having a first end 54 and a second end 56. The adapter plug 52 has an opening 58 formed therethrough. The first end 54 is adapted to couple with an opposing end of the return line 22 for the swimming pool 24. The second end 56 is adapted to couple with a compressor 60. An additional adapter plug 52 could be provided that would be adapted to fit a portable shop-type vacuum cleaner 62. The opening 58 in the additional adapter plug 52 could be larger to accommodate the shop vac 62. By turning on the compressor 60 or the portable shop-type vacuum cleaner 62 (in reverse), water that exists in the return line 22 is blown outwardly of the cylindrical check valve 12 with the water causing the ball 42 to be pushed away from the open second end 26 of the hollow securement portion 14 allowing the water to exit through the plurality of openings 44 in the intermediate extent 34 of the housing portion 16. After all of the water has exited the return line 22, the compressor 60 or portable shop-type vacuum cleaner is turned off and the spring 36 will return the ball 42 within the open second end 26 of the hollow securement portion 14.

The present invention is a winterizing check valve system for swimming pools 24 which enables owners to purge the pool lines 22 for winterizing.

The device 10 consists of two plastic check valves 12, two adapter rings, and two rubber plugs 52. The check valve ball 42 and steel spring 36 are contained in a small housing 16 which is enclosed on one end. A threaded coupling is attached to the open end of the housing 16. The adapter plugs 52 are made to fit a compressor 60 and a portable shop-type vacuum cleaner 62.

The valve 12 is designed to replace the return outlet fitting during the winter. Remove the return fitting and screw on the check valve 12. Attach the appropriate adapter plug 52 to the end of the line 22, and connect the end of the return line 22 to the compressor 60 or portable shop-type vacuum cleaner 62. Turn on the compressor 60, or the portable shop-type vacuum cleaner vac 62—in reverse. This will send a flow of air through the line 22 and out the check valve 12. The check valve 12 will be held open by the air flow, and the water in the line 22 will be forced out through the valve 12. When all the water is emptied from the line 22, then the air supply can be turned off. This will allow the check valve ball 42 to fall back into position, thus closing off the line 22.

Unlike the existing method for winterizing a pool, which requires two people, this valve 12 allows the pool owner to do the job alone. The spring 36 and valve ball 42 enable the line 22 to be closed off before any water can seep back into it, so that the line 22 is purged completely.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A winterizing check valve system for allowing pool owners to purge lines in a swimming pool for winterizing comprising, in combination:

a cylindrical check valve having a hollow securement portion and a housing portion, the hollow securement portion having an open first end with securement means thereon adapted for coupling with an end of a return line for a swimming pool, the hollow securement portion having an externally threaded open second end, the open second end tapering inwardly, the hollow securement portion having a radially extending retaining wall spaced apart from the externally threaded open second end toward said open first end, the housing portion having an internally threaded open first end, a closed second end, and an intermediate extent therebetween, the internally threaded open first end adapted for securement to the externally threaded open second end of the hollow securement portion, the housing portion having a spring therein, the spring having a first end and a second end, the first end secured to the closed second end of the housing portion, the housing portion having a ball coupled therein adjacent to the first end of the spring, the intermediate extent having a plurality of openings therein;

a clamp for securing the hollow securement portion of the cylindrical check valve to the return line of the swimming pool;

an adapter plug having a first end and a second end, the adapter plug having an opening formed therethrough, the first end being adapted to couple with an opposing end of the return line for the swimming pool, the second end being adapted to couple with a compressor.

2. The check valve system as described in claim 1 wherein the second end of the adapter plug is adapted to couple with a portable shop-type vacuum cleaner.

* * * * *